United States Patent [19]

Murata et al.

[11] 4,395,364

[45] Jul. 26, 1983

[54] DETERGENT COMPOSITION CONTAINING SULFONATE SURFACTANT AND POLYOXYALKYLENE ALKYL OR ALKENYL SULFURIC ACID ESTER SALT

[75] Inventors: Moriyasu Murata, Chiba; Kenji Okahashi, Funabashi, both of Japan

[73] Assignee: Kao Soap Co., Ltd., Tokyo, Japan

[21] Appl. No.: 368,483

[22] Filed: Apr. 14, 1982

Related U.S. Application Data

[63] Continuation of Ser. No. 205,220, Nov. 10, 1980, abandoned.

[30] Foreign Application Priority Data

Nov. 16, 1979 [JP] Japan ..... 54-148462

[51] Int. Cl.[3] ..... C11D 1/37; C11D 3/065

[52] U.S. Cl. ..... 252/526; 252/532; 252/535; 252/536; 252/539; 252/545; 252/558; 252/551; 252/554; 252/555

[58] Field of Search ..... 252/526, 532, 535, 545, 252/536, 539, 557, 554, 555, 558; 260/458

[56] References Cited

U.S. PATENT DOCUMENTS

| | | | |
|---|---|---|---|
| 3,775,349 | 11/1973 | Tuvell et al. | 252/547 |
| 3,843,706 | 10/1974 | Weil et al. | 260/458 |
| 3,931,271 | 1/1976 | Baumann et al. | 260/458 |
| 3,959,186 | 5/1976 | Harris | 252/551 |
| 4,077,917 | 3/1978 | Panzer | 252/545 |
| 4,122,044 | 10/1978 | Nakamura et al. | 252/532 |
| 4,163,732 | 8/1979 | Sai et al. | 252/99 |
| 4,180,485 | 12/1979 | Llenado | 252/532 |
| 4,259,215 | 3/1981 | Murata et al. | 252/528 |

FOREIGN PATENT DOCUMENTS

| | | |
|---|---|---|
| 2226988 | 12/1973 | Fed. Rep. of Germany . |
| 2355940 | 5/1974 | Fed. Rep. of Germany . |
| 2700071 | 7/1978 | Fed. Rep. of Germany . |
| 46-43550 | 12/1971 | Japan . |

*Primary Examiner*—P. E. Willis, Jr.

*Attorney, Agent, or Firm*—Flynn, Thiel, Boutell & Tanis

[57] ABSTRACT

A detergent composition comprising a sulfonate-type surface active agent and an alkyl ether sulfate containing oxypropylene and/or oxybutylene units in the molecule.

9 Claims, No Drawings

DETERGENT COMPOSITION CONTAINING SULFONATE SURFACTANT AND POLYOXYALKYLENE ALKYL OR ALKENYL SULFURIC ACID ESTER SALT

This is a continuation, of application Ser. No. 205,220, filed Nov. 10, 1980, abandoned.

The present invention relates to a detergent composition. More particularly, the present invention relates to a detergent composition which is excellent in the washing power and hard water resistance, and also is excellent in the rinsing property after washing.

In conventional detergent compositions, the main detergent ingredient is a surface active agent. Sulfonate-type surface active agents, such as linear alkyl benzene-sulfonic acid salts, α-olefin-sulfonic acid salts and alkane-sulfonic acid salts, especially linear alkyl benzene-sulfonic acid salts, have been widely used. Surface active agents of this type, however, are defective in that they react with hardness components contained in the washing water, such as calcium and magnesium, or with polyvalent metals contained as impurities, to form water-insoluble salts, and, thus, the intended activity of the detergent compositions, that is, their cleaning activity, is reduced. For eliminating this defect, a chelating agent, typified by sodium tripolyphosphate or sodium pyrophosphate, is incorporated as a builder, that is, a detergent assistant, in the detergent composition. However, environmental pollution caused by phosphorus-containing builders, such as sodium tripolyphosphate or sodium pyrophosphate, is now a serious social problem. In view of these circumstances, surface active agents having a good resistance to hard water have attracted attention in the art. As typical examples of surface active agents of this type, there can be mentioned, for example, polyoxyethylene alkyl sulfuric acid ester salts and polyoxyethylene alkyl ethers. These hard water-resistant surface active agents, however, are not satisfactory in all the properties required for surface active agents, but rather, they are insufficient in one or more of the desired properties. For example, a non-ionic surface active agent represented by a polyoxyethylene alkyl ether is defective in the bubble-forming (foaming) action, and a polyoxyethylene alkyl sulfuric acid ester salt is inferior in the rinsing property after washing, even though it is improved in its resistance to hard water. Moreover, if a powder detergent is prepared by using this polyoxyethylene alkyl sulfuric acid ester salt, the properties of the powder are not good and agglomeration or caking readily occurs. Such insufficient foaming property and insufficient rinsing property of the polyoxyethylene alkyl ethers and polyoxyethylene alkyl sulfuric acid ester salts, that are regarded as substitutes for the sulfonate-type surface active agents, are deemed to be serious defects at the present time, particularly where water resources are very limited. Accordingly, effective utilization of a sulfonate-type surface active agent has eagerly been desired.

We have discovered, surprisingly in view of the prior art, that if a sulfonate-type surface active agent is used in combination with a polyoxyalkylene alkyl or alkenyl sulfuric acid ester represented by the following general formula (1):

$$R—O—A—SO_3M \quad (1)$$

wherein R stands for a linear or branched primary or secondary alkyl or alkenyl group having 8 to 22 carbon atoms, A stands for a polyoxyalkylene group containing oxypropylene groups and/or oxybutylene groups, in which the average number of the cumulative oxyalkylene groups of A is in the range of from 0.5 to 30, and M stands for an alkali metal, an alkaline earth metal or an alkanolamine group having 1 to 3 alkanol groups having 2 or 3 carbon atoms, there is obtained a detergent composition which possesses excellent washing power and rinsing property, that is, the property of being easily rinsed, and the amount of the phosphate builder can be reduced or the phosphate builder can be eliminated entirely. We have now completed the present invention based on this discovery.

As the sulfonate-type surface active agent that is used in the present invention, there can be mentioned (a) a linear or branched alkyl benzene-sulfonic acid salt having an alkyl group having an average carbon atom number of from 10 to 16, (b) an olefin-sulfonic acid salt having an average carbon atom number of from 10 to 20, and (c) an alkane-sulfonic acid salt having an average carbon atom number of from 10 to 20. As the counter ion, there can be mentioned, for example, alkali metal ions such as sodium and potassium, an ammonium ion and an alkanolamine having 1 to 3 alkanol groups having 2 or 3 carbon atoms, such as monoethanolamine, diethanolamine, triethanolamine or triisopropanolamine. Sodium alkyl benzene-sulfonate is especially preferred as the sulfonate-type surface active agent. The sulfonate-type surface active agent is incorporated in the detergent composition in an amount of from 5 to 40% by weight (the term "%" used hereinafter is by weight, unless otherwise indicated), preferably from 8 to 30%.

As the specific polyoxyalkylene alkyl or alkenyl sulfuric acid ester salt containing specific oxyalkylene groups in the molecule, that is used in the present invention and is represented by the general formula (1), there can be mentioned the following compounds.

(i) Compounds represented by the following formula (2):

$$R_1O(PrO)_{m1}SO_3M \quad (2)$$

wherein $R_1O$ stands for a residue of a coconut oil-derived higher alcohol, a beef tallow-derived higher alcohol or a synthetic secondary higher alcohol or synthetic primary higher alcohol (having an iso ratio of 20 to 80%), PrO stands for an oxypropylene group, m1 is a number of from 1 to 10, and M is as defined above for the general formula (1).

(ii) Compounds represented by the following formula (3):

$$R_1O(PrO)_{m2}(EtO)_{m3}SO_3M \quad (3)$$

wherein each of m2 and m3 is a positive number with the proviso that the sum of m2 and m3 is from 1 to 10 and the m2/m3 ratio is from 4/1 to 1/4, EtO stands for an oxyethylene group, and the other symbols are as defined above for the formula (2).

(iii) Compounds represented by the following formula (4):

$$R_1O(BuO)_{m2}(EtO)_{m3}SO_3M \quad (4)$$

wherein BuO stands for an oxybutylene group, and the other symbols are as defined above for the formulae (2) and (3).

(iv) Compounds represented by the following formula (5):

$$R_1O(PrO,EtO)_{m1}SO_3M \quad (5)$$

wherein (PrO,EtO) indicates that the oxypropylene groups and oxyethylene groups are cumulated in any optional order and the other symbols are as defined above for the formulae (2) and (3).

(v) Compounds represented by the following formula (6):

$$R_1O(BuO)_{m1}SO_3M \quad (6)$$

wherein the symbols are as defined above for the formulae (2) through (5).

(vi) Compounds represented by the following formula (7):

$$R_1O(PrO,EtO,BuO)_{m1}SO_3M \quad (7)$$

wherein the symbols are as defined above for the formula (2) through (5).

The specific oxyalkylene group-containing polyoxyalkylene alkyl or alkenyl sulfuric acid ester salt that is used in the present invention is incorporated in the detergent composition in an amount of from 0.5 to 30%, preferably from 1.5 to 15%. If the amount is smaller than 0.5%, the foaming property and the rinsing property are insufficient, and if the amount exceeds 30%, no further improvement in the properties is obtained and the incorporation of such a large amount of the polyoxyalkylene alkyl or alkenyl sulfuric acid ester salt is disadvantageous from the economical viewpoint.

The detergent composition of the present invention can comprise up to 40%, preferably 1 to 20%, of a phosphate builder. As the phosphate builder, there are preferably employed sodium tripolyphosphate, potassium pyrophosphate, sodium pyrophosphate, potassium orthophosphate, sodium orthophosphate, sodium hexametaphosphate, potassium hexametaphosphate, sodium tetraphosphate and potassium tetraphosphate.

The following additional known ingredients can be incorporated into the detergent composition of the present invention according to need.

Surface Active Agents:

In addition to the polyoxyalkylene alkyl or alkenyl sulfuric acid ester of the formula (1) and the sulfonate-type surface active agent, that are used as the critical surface active agent ingredients, there can be incorporated anionic surface active agents such as saturated or unsaturated fatty acid salts having an average carbon atom number of from 10 to 20, alkyl sulfuric acid ester salts having an average carbon atom number of from 10 to 20, polyoxyethylene (an average added mol number of from 0.5 to 10.0) alkyl (an average carbon atom number of from 8 to 20) sulfuric acid ester salts, polyoxyalkylene (a carbon atom number of from 2 to 4 and an average added mol number of from 0.5 to 10.0) alkyl or alkenyl (an average carbon atom number of from 10 to 20) ether carboxylic acid salts and α-sulfofatty acid salts or esters having an average carbon atom number of from 10 to 20, and amphoteric surface active agents represented by the following formula:

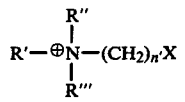

wherein R′ stands for an alkyl or alkenyl group having 10 to 20 carbon atoms, R″ and R‴ each stand for an alkyl group having 1 to 4 carbon atoms, optionally containing from 1 to 10 mols of ethylene oxide units adducted thereto, n′ is an integer of from 1 to 3, and X stands for a group —COO⊖ or —SO₃⊖.

Furthermore, non-ionic surface active agents can be incorporated in the detergent composition. For example, the following non-ionic surface active agents can be incorporated.

(A) Polyoxyethylene alkyl or alkenyl ethers containing an alkyl or alkenyl group having from 10 to 20 carbon atoms on the average and from 1 to 20 mols of added ethylene oxide units.

(B) Polyoxyethylene alkyl phenyl ethers containing an alkyl group having from 6 to 12 carbon atoms on the average and 1 to 20 mols of added ethylene oxide units.

(C) Polyoxypropylene alkyl or alkenyl ethers containing an alkyl or alkenyl group having from 10 to 20 carbon atoms on the average and 1 to 20 mols of added propylene oxide units.

(D) Polyoxybutylene alkyl or alkenyl ethers containing an alkyl or alkenyl group having from 10 to 20 carbon atoms on the average and 1 to 20 mols of added butylene oxide units.

(E) Non-ionic surface active agents containing an alkyl or alkenyl group having from 10 to 20 carbon atoms on the average and 1 to 30 mols of added ethylene oxide and propylene oxide units or added ethylene oxide and butylene oxide units, in which the ethylene oxide/propylene oxide molar ratio or the ethylene oxide/butylene oxide molar ratio is in the range of from 0.1/9.9 to 9.9/0.1.

(F) Higher fatty acid alkanolamines represented by the following general formula and alkylene oxide adducts thereof:

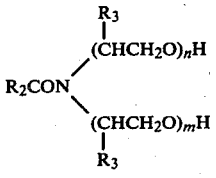

wherein $R_2$ stands for an alkyl or alkenyl group having from 10 to 20 carbon atoms, $R_3$ stands for H or $CH_3$, n is an integer of from 1 to 3, and m is an integer of from 0 to 3.

(G) Sucrose-fatty acid esters comprising sucrose and a fatty acid having an average carbon atom number of from 10 to 20.

(H) Fatty acid-glycerin monoesters comprising glycerin and a fatty acid having an average carbon atom number of from 10 to 20.

(I) Alkylamine oxides represented by the following formula:

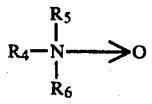

wherein $R_4$ stands for an alkyl or alkenyl group having from 10 to 20 carbon atoms, and $R_5$ and $R_6$ stand for an alkyl group having from 1 to 3 carbon atoms.

Builders:

As the builder, there can be incorporated aminopolyacetic acid salts such as nitrilotriacetic acid salts, ethylene diamine-tetraacetic acid salts and diethylene triamine-pentaacetic acid salts, hydroxycarboxylic acid salts such as citric acid salts, malic acid salts and glycolic acid salts, and polymeric electrolytes such as polyacrylic and alkali-hydrolyzed salts of vinyl acetate/-maleic anhydride copolymers. Furthermore, the detergent composition can comprise, as the inorganic electrolyte or alkaline agent, from 1 to 50% by weight, preferably 5 to 30% by weight, of at least one alkali metal salt selected from alkali metal silicates, alkali metal carbonates and alkali metal sulfates. Moreover, alkanolamines represented by triethanolamine, diethanolamine, monoethanolamine and triisopropanolamine can be incorporated.

Crystalline and/or amorphous alumino-silicates represented by the following formula can be incorporated:

$$X(M_2O).Al_2O_3.Y(SiO_2).Z(P_2O_5).\omega(H_2O)$$

wherein M stands for Na or K, and X, Y and Z represent the mol numbers of the respective components which satisfy the requirements of $0.20 \leqq X \leqq 1.10$, $0.20 \leqq Y \leqq 4.00$ and $0.001 \leqq Z \leqq 0.80$, and $\omega$ is an optional positive number.

Moreover, a re-contamination-preventing agent such as polyethylene glycol, polyvinyl alcohol, polyvinyl pyrrolidone or carboxymethyl cellulose, a bleaching agent such as sodium percarbonate, sodium perborate and sodium sulfate-sodium chloride-hydrogen peroxide adduct, a commercially available fluorescent dye as a whitening agent, a perfume, an enzyme and a bluing agent can be incorporated in the detergent composition of the present invention according to need.

Still further, there can be incorporated a water-insoluble substance such as talc, finely divided silica, clay or calcium silicate (for example, Microcell manufactured by Johns-Manville Co.).

The detergent composition of the present invention can take any of powder, liquid, pasty and solid forms. In the case of a liquid detergent composition, there can be incorporated organic additives, for example, lower alcohols such as ethanol and isopropanol, glycols such as ethylene glycol and propylene glycol, lower alkyl ethers of such glycols, urea, benzene-sulfonic acid salts, p-toluenesulfonic acid salts, xylenesulfonic acid salts, benzoic acid salts and salicylic acid salts. Furthermore, polyvinyl acetate, a vinyl acetate-styrene copolymer or polystryrene can be added for rendering the liquid detergent opaque.

Thus, according to the present invention a detergent composition which possesses excellent washing power and hard water resistance, which has a good foaming property and a high rinsing property, can be obtained even though the amount of the phosphate builder contained therein is reduced or omitted entirely.

The present invention will now be described in detail with reference to the following illustrative examples that by no means limit the scope of the present invention.

The test methods adopted in the examples are as follows.

(1) Washing Power Test:

In 1 l of an aqueous solution of the detergent sample there were immersed 12 sheets of artificially contaminated cloths having a size of 10 cm×10 cm and non-contaminated cloths having the same size so that the cloth/liquid ratio was 1/60. Washing was carried out at 100 rpm under the conditions described below by using a Terg-O-meter.

The washing conditions and the oil composition used for preparing the artificially contaminated cloths are as follows.

[Washing Conditions]

Detergent concentration: 0.1%
Hardness of water: 8°DH
Water temperature: 20° C.
Rinsing: conducted for 5 minutes by using city water

[Oil Composition for Preparing Artificially Contaminated Cloths]

Cotton seed oil: 60%
Cholesterol: 10%
Oleic acid: 10%
Palmitic acid: 10%
Liquid and solid paraffins: 10%

The reflectances of the starting cloth before contamination (carbon black was incorporated as the indicator according to the conventional method) and the contaminated cloth before and after washing were measured by an automatic colorimeter (manufactured by Shimazu Seisakusho), and the washing ratio (%) (average value obtained with respect to the 12 test cloths) was calculated according to the following formula and the washing power was evaluated based on this washing ratio:

$$\text{Washing ratio (\%)} = \frac{\text{(reflectance after washing)} - \text{(reflectance before washing)}}{\text{(reflectance of starting cloth)} - \text{(reflectance before washing)}} \times 100$$

(2) Rinsing Test:

A pulsator type electric washing machine (manufactured by Toshiba) was charged with 30 l of city water maintained at 20° C. and 40 g of the detergent sample was added and dissolved therein by agitation. A contaminated cloth was formed by uniformly coating 3 g of the above-mentioned contaminating oil on 1 kg of cotton underwear, and the contaminated cloth was immersed in the washing liquid and was strongly agitated therein for 10 minutes. After completion of this washing operation, the washed contaminated cloth was treated for 1 minute by a dehydrating machine to effect dehydration. The washing liquid was discharged from the washing machine, and 30 l of clean city water, as the first rinsing liquid, was charged into the washing machine. The dehydrated cloth was immersed in this rinsing liquid and was strongly agitated for 3 minutes. The foaming state in the washing tank was examined and evaluated according to the following standard. The above procedure was repeated and the foaming state at the second rinsing was similarly evaluated.

The foaming state at the rinsing step was evaluated according to the following standard.

| Index | Foaming State |
|---|---|
| 5 | foam rose in a mountain-like shape to the height of the gauge board |
| 4 | foam rose in a mountain-like shape but did not reach the gauge board |
| 3 | foam covered the entire liquid surface in a thickness of 3 to 5 cm |
| 2 | foam covered the entire liquid surface in a thickness of 1 to 2 cm |
| 1 | foam covered about ½ of the liquid surface, but the remaining ½ of the liquid surface was seen |
| 0 | no foam was observed |

Also the transparency of the discharged liquid at rinsing step is an important factor for determination of the rinsing property. The transparency of the discharged liquid at the second rinsing step was examined with the naked eye and evaluated according to the following standard.

○: as transparent as city water

X: the cloth in the rinsing liquid can be seen but the discharged liquid was opaque XX: the discharged liquid was opaque and the cloth in the rinsing liquid cannot be seen The index ○ indicates the best rinsing property and the rank ○ indicates the best transparency.

(3) Foaming During Washing:

Just after completion of the washing operation, the foam state was examined and evaluated according to the same standard as adopted as the rinsing test.

EXAMPLE 1

Detergents having the respective compositions listed in Table 1 were prepared, and the foaming property and the rinsing property (the transparency of the discharged liquid) were examined. The results obtained are shown in Table 1.

TABLE 1

| | Present Invention | | Comparison | | | | | |
|---|---|---|---|---|---|---|---|---|
| Composition (%) | 1 | 2 | 3 | 4 | 5 | 6 | 7 | 8 |
| Sodium alkyl (average carbon number = 12) benzene-sulfonate | 15 | | 15 | 15 | 15 | | | 20 |
| Sodium α-olefin (average carbon number = 16) sulfonate | | 15 | | | | | | |
| Sodium polyoxyalkylene alkyl[1] sulfate | 5 | 5 | | | | 5 | 20 | |
| Sodium polyoxyethylene(3) alkyl (average carbon number = 14.5) sulfate | | | 5 | | | | | |
| Polyoxyethylene(10)secondary alkyl (average carbon number = 13) ether | | | | 5 | | | | |
| Sodium alkyl (average carbon number = 14.5) sulfate | | | | | 5 | 15 | | |
| Sodium tripolyphosphate | 15 | 15 | 15 | 15 | 15 | 15 | 15 | 15 |
| Sodium silicate | 10 | 10 | 10 | 10 | 10 | 10 | 10 | 10 |
| Sodium carbonate | 10 | 10 | 10 | 10 | 10 | 10 | 10 | 10 |
| Polyethylene glycol (average molecular weight = 6000) | 1 | 1 | 1 | 1 | 1 | 1 | 1 | 1 |
| Carboxymethyl cellulose | 1 | 1 | 1 | 1 | 1 | 1 | 1 | 1 |
| Fluorescent dye | 0.5 | 0.5 | 0.5 | 0.5 | 0.5 | 0.5 | 0.5 | 0.5 |
| Water | 10 | 10 | 10 | 10 | 10 | 10 | 10 | 10 |
| Glauber salt | balance | balance | balance | balance | balance | balance | balance | balance |
| Washing ratio (%) | 59 | 59 | 56 | 58 | 55 | 59 | 59 | 56 |
| Foaming during washing in washing machine (manufactured by Toshiba) | 4 | 4 | 3 | 0 | 3 | 1 | 0 | 3 |
| Rinsing property (transparency of discharged liquid) | ○ | ○ | X | ○ | X | ○ | ○ | X |

Note

[1]$RO(PrO)_2(EtO)_1SO_3Na$ in which R has an average carbon number of 14.5 and the branching ratio is 36%

EXAMPLE 2

In the detergent composition set forth below, the kind of the polyoxyalkylene alkyl sulfuric acid ester salt employed was changed, and the rinsing property was examined. The results obtained are shown in Table 2.

| Detergent composition: | |
|---|---|
| sodium alkyl (average carbon number = 12.5) benzene-sulfonate | 10% |
| polyoxyalkylene alkyl sulfuric acid ester salt (various, see Table 2) | 5% |
| sodium pyrophosphate | 5% |
| sodium orthophosphate | 5% |
| sodium silicate | 13% |
| sodium carbonate | 11% |
| polyethylene glycol (average molecular weight = 6000) | 0.5% |
| carboxymethyl cellulose | 0.5% |
| fluorescent dye and perfume | appropriate amounts |
| water | 8% |
| Glauber salt | balance |

TABLE 2

| | Rinsing effect | |
|---|---|---|
| Polyoxyalkylene alkyl sulfuric acid ester salt | rinsing property | transparency of discharged liquid |
| $C_8O(PrO)_1SO_3Na$ | ○ | ○ |
| $C_{12}O(PrO)_3SO_3Na$ | ○ | ○ |
| $RtallO(PrO)_8SO_3Na$ | ○ | ○ |
| $R_1O(PrO)_{2.5}SO_3Na$ | ○ | ○ |
| $R_2O(PrO)_{2.5}SO_3Na$ | ○ | ○ |
| $C_{18}O(PrO)_{2.5}SO_3Na$ | ○ | ○ |
| $RcocoO(PrO)_{1.5}SO_3Na$ | ○ | ○ |

TABLE 2-continued

| Polyoxyalkylene alkyl sulfuric acid ester salt | Rinsing effect: rinsing property | Rinsing effect: transparency of discharged liquid |
|---|---|---|
| $R_2O(PrO)_{2.5}SO_3\frac{1}{2}Mg$ | O | ○ |
| $C_{12}O(BuO)_{1.5}SO_3Na$ | O | ○ |
| $R_2O(BuO)_{2.5}SO_3Na$ | O | ○ |
| $C_{10}O(PrO)_1(EtO)_{0.5}SO_3Na$ | O | ○ |
| $C_{12}O(PrO)_{1.5}(EtO)_{0.5}SO_3Na$ | O | ○ |
| $R_1O(PrO)_2(EtO)_{0.5}SO_3Na$ | O | ○ |
| $R_2O(PrO)_{0.5}(EtO)_{2.5}SO_3Na$ | O | ○ |
| $R_2O(PrO)_1(EtO)_2SO_3\frac{1}{2}Ca$ | O | ○ |
| $R_2O(PrO)_{1.5}(EtO)_{1.5}SO_3Na$ | O | ○ |
| $R_2O(PrO)_2(EtO)_1SO_3Na$ | O | ○ |
| $R_2O(PrO)_{2.5}(EtO)_{0.5}SO_3Na$ | O | ○ |
| $R_2O(EtO)_{0.5}(PrO)_{2.5}SO_3Na$ | O | ○ |
| $R_3O(PrO,EtO)_{m1=1,\ m2=1}SO_3Na$ | O | ○ |
| $R_4O(PrO,EtO)_{m1=5,\ m2=3}SO_3Na$ | O | ○ |
| $R_2O(BuO)_1(EtO)_2SO_3Na$ | O | ○ |

Note
$C_8$: linear octyl group
$C_{10}$: linear decyl group
$C_{12}$: linear dodecyl group
$C_{18}$: linear stearyl group
$R_{COCO}$: coconut alcohol residue
$R_{TALL}$: beef tallow alcohol residue

| Synthetic Alcohol Residue | Average Carbon Number | Iso Ratio |
|---|---|---|
| $R_1$ | 12.4 | 35.5% |
| $R_2$ | 14.5 | 36.1% |
| $R_3$ | 14.3 | 21.8% |
| $R_4$ | 17 | 71.5% |

(PrO,EtO): random addition

The embodiments of the invention in which an exclusive property or privilege is claimed are defined as follows:

1. A powder detergent composition, consisting essentially of (A) from 8 to 30% by weight of anionic surface active agent selected from the group consisting of linear or branched, alkyl benzene-sulfonic acid salts in which the alkyl group has an average carbon atom number of from 10 to 16, olefin-sulfonic acid salts having an average carbon atom number of from 10 to 20 and alkane-sulfonic acid salts having an average carbon atom number of from 10 to 20, wherein the counter ion of said salts is selected from the group consisting of sodium, potassium, ammonium or alkanolamine having 1 to 3 alkanol groups having 2 or 3 carbon atoms, (B) from 1.5 to 15% by weight of polyoxyalkylene alkyl or alkenyl sulfuric acid ester salt selected from the group consisting of compounds having the formula $$R_1O(PrO)_{m1}SO_3M \quad (2)$$

wherein $R_1O$ is a residue obtained by removal of a hydrogen from coconut oil-derived higher alcohol, beef tallow-derived higher alcohol, synthetic secondary higher alcohol having 8 to 22 carbon atoms, or synthetic primary alcohol having 8 to 22 carbon atoms and having an iso ratio of 20 to 80%, PrO is oxypropylene, m1 is a number of from 1 to 10, and M is an alkali metal, an alkaline earth metal or an alkanolamine having 1 to 3 alkanol groups having 2 or 3 carbon atoms, compounds having the formula $$R_1O(PrO)_{m2}(EtO)_{m3}SO_3M \quad (3)$$

wherein each of m2 and m3 is a positive number with the proviso that the sum of m2 and m3 is from 1 to 10 and the m2/m3 ratio is in the range of from 4/1 to 1/4, EtO is oxyethylene, and the other symbols have the same meaning as defined above, compounds having the formula $$R_1O(BuO)_{m2}(EtO)_{m3}SO_3M \quad (4)$$

wherein BuO is oxybutylene, and the other symbols have the same meanings as defined above, compounds having the formula $$R_1O(PrO,EtO)_{m1}SO_3M \quad (5)$$

wherein (PrO,EtO) is oxypropylene and oxyethylene arranged in random order, and the other symbols have the same meanings as defined above, compounds having the formula $$R_1O(BuO)_{m1}SO_3M \quad (6)$$

wherein the symbols have the same meanings as defined above, and compounds having the formula $$R_1O(PrO,EtO,BuO)_{m1}SO_3M \quad (7)$$

wherein the symbols have the same meanings as defined above, (C) 1 to 20% by weight of detergent builder suitable for use in powder clothes washing detergent compositions, and (D) from 1 to 50% by weight of at least one alkali metal salt selected from the group consisting of alkali metal silicates, alkali metal carbonates and alkali metal sulfates.

2. A powder detergent composition as set forth in claim 1, wherein the sulfonate surface active agent is a linear or branched, alkyl benzene-sulfonic acid salt having an alkyl group having an average carbon atom number of from 10 to 16.

3. A powder detergent composition as set forth in claim 1, wherein the polyoxyalkylene alkyl or alkenyl sulfuric acid ester salt is a compound having the formula (2).

4. A powder detergent composition as set forth in claim 1, wherein the polyoxyalkylene alkyl or alkenyl sulfuric acid ester salt is a compound having the formula (3).

5. A powder detergent composition as set forth in claim 1, wherein the polyoxyalkylene alkyl or alkenyl sulfuric acid ester salt is a compound having the formula (5).

6. A powder detergent composition as set forth in claim 1 in which the weight ratio of (A)/(B) is from 10/1 to 1.33/1.

7. A powder detergent composition as set forth in claim 1 in which the weight ratio of (A)/(B) is from 4/1 to 2/1.

8. A powder detergent composition as set forth in claim 1 in which said detergent builder is a phosphate detergent builder.

9. A powder detergent composition as set forth in claim 1 in which said detergent builder is selected from the group consisting of aminopolyacetic acid salts, hydroxycarboxylic acid salts, polymeric electrolytes and crystalline and/or amorphous alumino-silicates having the formula $$X(M_2O).Al_2O_3.Y(SiO_2).Z(P_2O_5).\omega(H_2O)$$

wherein M is Na or K, and X, Y and Z are the mole numbers of the respective components which satisfy the relations $0.20 \leqq X \leqq 1.10$, $0.20 \leqq Y \leqq 4.00$ and $0.001 \leqq Z \leqq 0.80$, and $\omega$ is an optional positive number.

* * * * *